US010745911B2

(12) United States Patent
Johnson

(10) Patent No.: US 10,745,911 B2
(45) Date of Patent: Aug. 18, 2020

(54) DRAINAGE CHANNEL FOR USE IN A BUILDING WALL

(71) Applicant: Innovation Calumet LLC, Valparaiso, IN (US)

(72) Inventor: Gary R. Johnson, Gary, IN (US)

(73) Assignee: INNOVATION CALUMET LLC, Valparaiso, IN (US)

( * ) Notice: Subject to any disclaimer, the term of this patent is extended or adjusted under 35 U.S.C. 154(b) by 0 days.

(21) Appl. No.: 16/379,987

(22) Filed: Apr. 10, 2019

(65) Prior Publication Data

US 2019/0309509 A1 Oct. 10, 2019

Related U.S. Application Data

(60) Provisional application No. 62/655,774, filed on Apr. 10, 2018.

(51) Int. Cl.
*E04B 1/70* (2006.01)
*E04B 2/00* (2006.01)
*E04B 1/76* (2006.01)

(52) U.S. Cl.
CPC ..... *E04B 1/7046* (2013.01); *E04B 1/7604* (2013.01); *E04C 2/46* (2013.01)

(58) Field of Classification Search
CPC ..... E04B 1/70; E04B 1/7046; E04F 13/06
USPC ..... 52/302.1
See application file for complete search history.

(56) References Cited

U.S. PATENT DOCUMENTS 3,206,806 A * 9/1965 Powell ..... E04F 19/064 52/287.1
3,343,323 A * 9/1967 Mayfield ..... E04B 1/7076 52/302.3
3,568,391 A * 3/1971 Conway ..... E04B 1/7023 52/586.2
5,836,135 A * 11/1998 Hagan ..... E04B 1/762 52/836
6,018,924 A * 2/2000 Tamlyn ..... E04F 19/02 52/287.1
6,293,064 B1 * 9/2001 Larson ..... E04B 1/762 52/209
6,410,118 B1 * 6/2002 Reicherts ..... B32B 13/04 428/141
6,470,638 B1 * 10/2002 Larson ..... E04B 1/765 52/254
7,219,477 B2 * 5/2007 Leffler ..... E04F 13/00 52/277

(Continued)

*Primary Examiner* — Paola Agudelo
(74) *Attorney, Agent, or Firm* — McDonnell Boehnen Hulbert & Berghoff LLP

(57) ABSTRACT

The disclosure provides example drainage channels, drainage systems, building walls and methods. An example drainage channel includes a drainage panel for conveying water within a building wall. The drainage panel is impermeable and has a first end and a second end. A support panel is coupled to the first end or the second end of the drainage panel such that the support panel is configured to be arranged vertically relative to the building wall. The drainage panel is configured to be arranged either perpendicular to an exterior sheathing of the building wall or angled downward from the first end of the drainage panel toward both the second end of the drainage panel and the exterior sheathing of the building wall.

18 Claims, 5 Drawing Sheets

(56) References Cited

U.S. PATENT DOCUMENTS

| | | | | |
|---|---|---|---|---|
| 7,546,719 | B1 * | 6/2009 | Guevara | E04F 13/06 52/302.6 |
| 7,584,587 | B2 * | 9/2009 | Ouellette | E04F 13/0889 33/646 |
| 7,743,575 | B2 * | 6/2010 | Ito | E04F 13/0889 52/461 |
| 8,281,530 | B2 * | 10/2012 | Chaussee | E04F 13/0803 52/290 |
| 8,578,660 | B2 * | 11/2013 | Nolan | E04F 19/045 52/302.6 |
| 8,596,019 | B2 * | 12/2013 | Aitken | E04B 2/82 52/710 |
| D700,717 | S * | 3/2014 | Campacci | D25/119 |
| 9,127,467 | B2 | 9/2015 | Johnson | |
| 9,366,040 | B2 * | 6/2016 | Singh | E04B 1/7038 |
| 2003/0177736 | A1 * | 9/2003 | Gatherum | E04B 1/70 52/741.1 |
| 2006/0277854 | A1 * | 12/2006 | Egan | E04B 1/70 52/302.3 |
| 2009/0183453 | A1 * | 7/2009 | Koessler | E04F 13/007 52/302.3 |
| 2011/0302863 | A1 * | 12/2011 | Sourlis | E02D 19/00 52/302.1 |
| 2012/0066984 | A1 * | 3/2012 | Thompson | E04D 1/18 52/11 |
| 2016/0069071 | A1 * | 3/2016 | Remmele | E04F 13/068 52/232 |
| 2017/0254091 | A1 * | 9/2017 | Friel | E04B 1/765 |

* cited by examiner

DRAINAGE CHANNEL FOR USE IN A BUILDING WALL

CROSS-REFERENCE TO RELATED APPLICATION

This application claims the benefit of the filing date of U.S. Non-Provisional Patent Application Ser. No. 62/655,774, filed Apr. 10, 2018, which is hereby incorporated by reference in its entirety.

BACKGROUND

Many building methods involve the application of cementitious material to the face of a wall, including stucco, adhered masonry, and other similar applications. Typically, a weather resistive barrier ("WRB") is applied over the exterior sheathing of the wall, such as plywood, and then a lath or mesh is fastened to the exterior sheathing over the WRB. The lath, which may be metal, fiberglass, or a polymer-based material, provides for mechanical keying of the unhardened stucco or plaster.

In this type of wall construction, the cementitious material itself may be relatively porous. Further, joints or discontinuities in the wall construction may provide a path for water to migrate behind the cementitious material. Condensation may also occur at different points within the wall. In sum, it is not uncommon for moisture to find its way behind the stucco or adhered masonry surface.

Accordingly, the WRB behind the stucco or adhered masonry surface provides a drainage plane against which water may accumulate and drain to the bottom of the wall. At the bottom of the wall, a weep screed or similar structure that provides the bottom edge for the cementitious material may also provide weep holes that allow the water to exit the wall. In some cases, a drainage material, such as a water channel material, may be provided between the WRB and the lath to facilitate the drainage, as generally discussed in U.S. Pat. No. 9,127,467.

In a traditional example application as described above, the wall may include thermal insulation that is located inboard of, or inside, the exterior sheathing. For instance, fiberglass insulation may be unrolled and placed in between the vertical wall studs to which the exterior sheathing is attached. In such an example, the thermal insulation is discontinuous at each of the stud locations within the wall cavity.

Increasingly, modern energy codes and building code standards have begun to call for continuous thermal insulation, which generally takes the form of a foam insulation board, such as polystyrene, that is installed outboard of, or exterior to, the exterior sheathing and over the WRB. The lath is then applied outboard of the continuous insulation. The insulating material is generally impervious to water, aside from the seams that occur between adjacent pieces of the foam insulation board. Thus, a system with dual drainage planes is created—a primary drainage plane on the exterior face of the continuous insulation and immediately behind the lath (and drainage material, if included), and a secondary drainage plane located behind the insulating material, at the WRB. In addition, current best practice is to use a drainage mesh between cladding and the continuous insulation (similar to adhered veneers using a water channel material and spacers without the lath member disclosed in U.S. Pat. No. 9,127,467).

SUMMARY

In a first aspect, an example drainage channel is provided. The drainage channel includes (a) a drainage panel for conveying water within a building wall, wherein the drainage panel is impermeable and comprises a first end and a second end and (b) a support panel coupled to the first end or the second end of the drainage panel such that the support panel is configured to be arranged vertically relative to the building wall, where the drainage panel is configured to be arranged either perpendicular to an exterior sheathing of the building wall or angled downward from the first end of the drainage panel toward both the second end of the drainage panel and the exterior sheathing of the building wall.

In a second aspect, a drainage system for attachment to an exterior sheathing of a panel structure is provided. The drainage system includes (a) a weather resistive barrier coupled to the exterior sheathing, where the weather resistive barrier forms a secondary drainage plane of the drainage system, (b) an insulating material coupled to the exterior sheathing, where the insulating material is positioned outboard of and adjacent to the weather resistive barrier, (c) a water channel material coupled to the exterior sheathing, where the water channel material is positioned outboard of and adjacent to the insulating material, and where the water channel material forms a primary drainage plane of the drainage system, (d) a lath member coupled to the exterior sheathing, where the lath member is positioned outboard of and adjacent to the water channel material, and (e) the drainage channel according to the first aspect, where the first end of the drainage channel is positioned outboard of the water channel material such that any water from the primary drainage plane is directed inboard toward the weather resistive barrier.

In a third aspect, a building wall is provided. The building wall includes (a) an exterior sheathing, (b) the drainage system according to the second aspect coupled to the exterior sheathing via a plurality of fasteners, (c) a corner bead comprising a first flange and a second flange, wherein the first flange is fastened to the lath member, and where the second flange is positioned adjacent to a bottom surface of the drainage panel and perpendicular to the first flange, and (d) a cementitious material applied to the lath member and the corner bead.

In a fourth aspect, a method of installing a drainage channel within a building wall is provided. The method includes (a) positioning the drainage system according the second aspect such that a rear panel is positioned inboard of a portion of the weather resistive barrier, such that water in the secondary drainage plane is directed to the drainage well, and where the front panel is positioned outboard of the water channel material, such that any water in the primary drainage plane is directed to the drainage well via the drainage panel, and (b) fastening the rear panel of the drainage channel to the exterior sheathing via a plurality of fasteners.

The features, functions, and advantages that have been discussed can be achieved independently in various examples or may be combined in yet other examples further details of which can be seen with reference to the following description and drawings.

Figure 1:
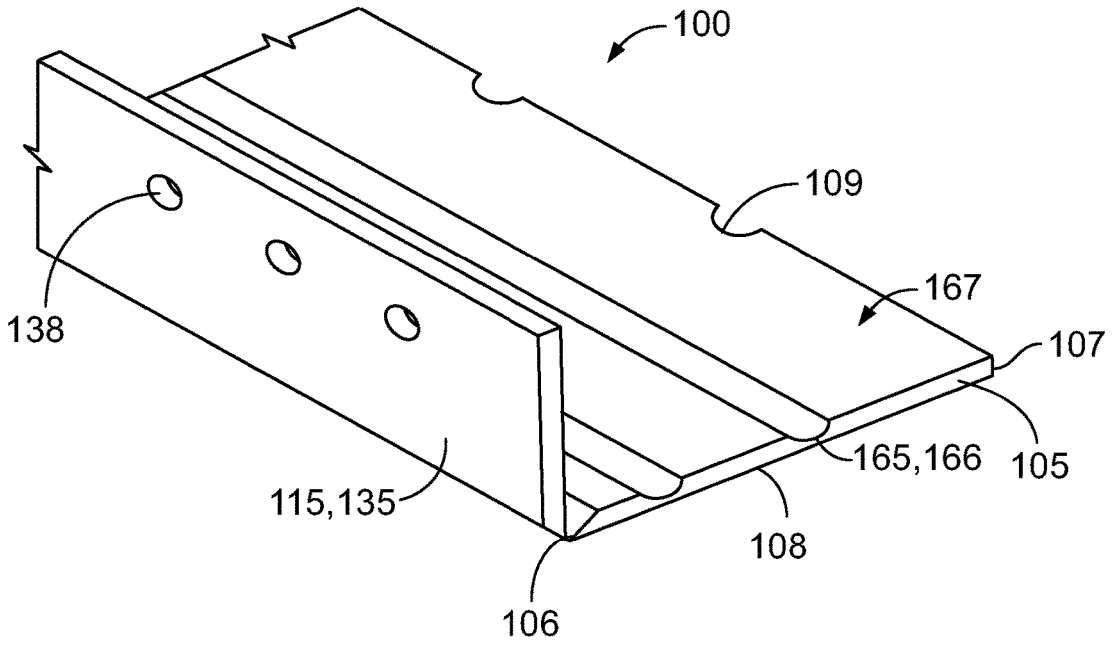
FIG. 1 is a perspective view of a drainage channel, according to one example implementation.
Figure 2:
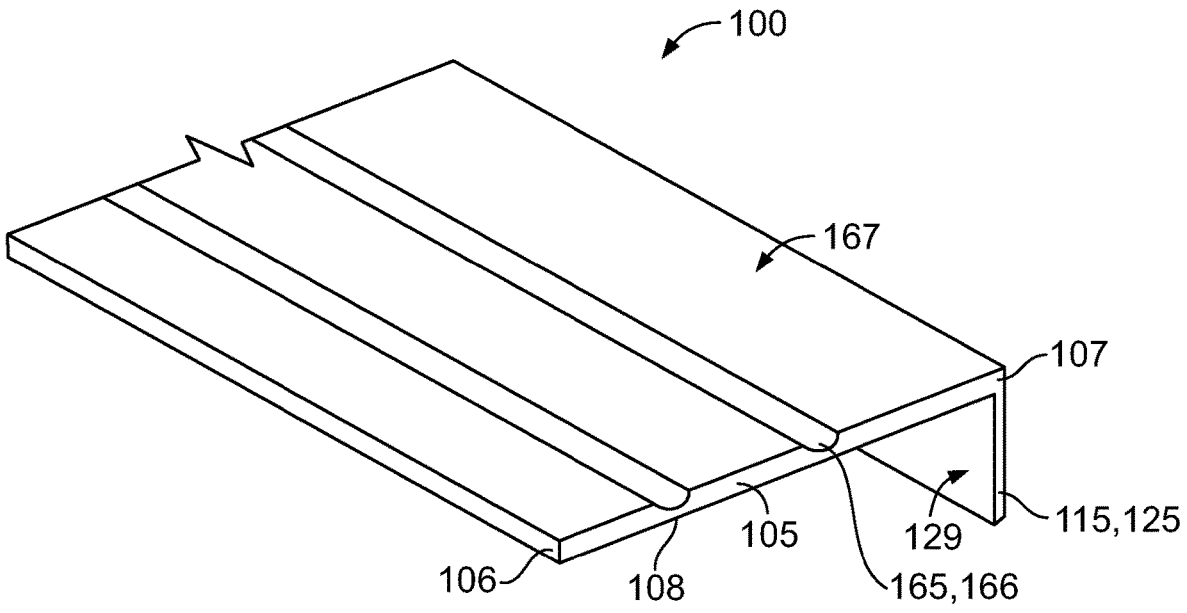
FIG. 2 is a perspective view of a drainage channel, according to one example implementation.

The drawings are for the purpose of illustrating examples, but it is understood that the inventions are not limited to the arrangements and instrumentalities shown in the drawings.

DETAILED DESCRIPTION

Embodiments of the drainage channel, drainage system, building wall and methods described herein advantageously permit a designated drainage path for moisture that reaches a primary drainage plane to exit the wall. Further, the insulating material of a building wall may have a thickness from 1 inch up to 4 inches or more, which increases the overall thickness of the wall cross-section. The present disclosure provides a return that may extend over several inches at the bottom of a wall, or at the upper jamb of a window or door. In this arrangement, water in the primary drainage plane above the return that may accumulate within the wall on the top surface of the return may minimize moisture damage or freeze/thaw action, among other possibilities. In addition, the embodiments disclosed herein provide a drainage channel solution for conveying water from the primary drainage plane to the secondary drainage plane at the WRB.

The examples that follow are generally discussed with reference to a stucco wall system. However, other types of adhered masonry and stone veneer walls that may include continuous insulation are also contemplated, and may also benefit from the embodiments discussed herein. Still further, other rain screen-type walls (e.g., metal panels rather than masonry-type walls) may benefit from these same embodiments. For example, a rain screen wall is one in which the exterior cladding is not completely waterproof, some incidental water will necessarily penetrate the wall and must be drained.

Moreover, the embodiments provided herein advantageously channel water back to a drainage system near the building structure that includes a drainage path length at least as long as the continuous insulation. And the embodiments provided herein provide new methods and structure to couple the drainage channel to the wall structure both mechanically or with adhesive to the insulation (which itself is fastened to the wall structure) or, alternatively, utilizing coupling methods and structure extending through the wall structure.

FIGS. 1-6 depict drainage channel 100 that includes a drainage panel 105 for conveying water within a building wall 110. The drainage panel 105 is impermeable and has a first end 106 and a second end 107. The drainage channel 100 also includes a support panel 115 coupled to the first end 106 or the second end 107 of the drainage panel 105 such that the support panel 115 is configured to be arranged vertically relative to the building wall 110. The drainage panel 105 is configured to be arranged either perpendicular to an exterior sheathing 120 of the building wall 110 or angled downward from the first end 106 of the drainage panel 105 toward both the second end 107 of the drainage panel 105 and the exterior sheathing 120 of the building wall 110. In various optional examples, the drainage panel 105 and the support panel 115 are formed from at least one of a polymer-based material, a metal material, a metal alloy material, or a composite material. In another option embodiment, the various components of the drainage channel 100 are integrally formed as a single component. The drainage panel 105 may be positioned approximately horizontally within the building wall 110 near a lower termination of the wall 110. For instance, the drainage panel 105 may be located at a bottom portion of the wall, near the foundation of the structure. Additionally or alternatively, the drainage panel 105 may be located at the upper edge of a window or a doorjamb.

In some implementations, a positive gradient from the first end 106 of the drainage panel 105 to the second end 107, to encourage water to drain out from the wall 110. Alternatively, because the drainage channel 100 may be formed from a metal or polymer-based material, among other possibilities, a small amount of water pooling on the drainage panel 105 may have negligible effects. Thus, the drainage panel 105 may be positioned with no pitch within the wall 110, relying on the surface pressure of the pooling water to eventually force the water toward the second end 107 of the drainage panel 105 and the weather resistant barrier 185.

In one example implementation shown in FIGS. 3-6, the drainage panel 105 is configured to be positioned horizontally within the building wall 110 such that the first end 106 of the drainage panel 105 is positioned outboard of the second end 107 of the drainage panel 105 relative to an exterior sheathing 120 of the building wall 110. The support panel 115 is a rear panel 125 coupled to the second end 107 of the drainage panel 105. The rear panel 125 is configured to be fastened to the exterior sheathing 120 of the building wall 110 and inboard of an insulating material 130 of the building wall 110. As used herein, "outboard" means arranged exterior relative to a given component, and "inboard" means arranged interior relative to a given component. In this embodiment, one or more notches 109 may be provided in the drainage panel 105 where the drainage panel 105 is coupled to the rear panel 125 to allow water to drain from the surface of the drainage panel 105 and down a weather resistant barrier 185, described below.

Figure 5:
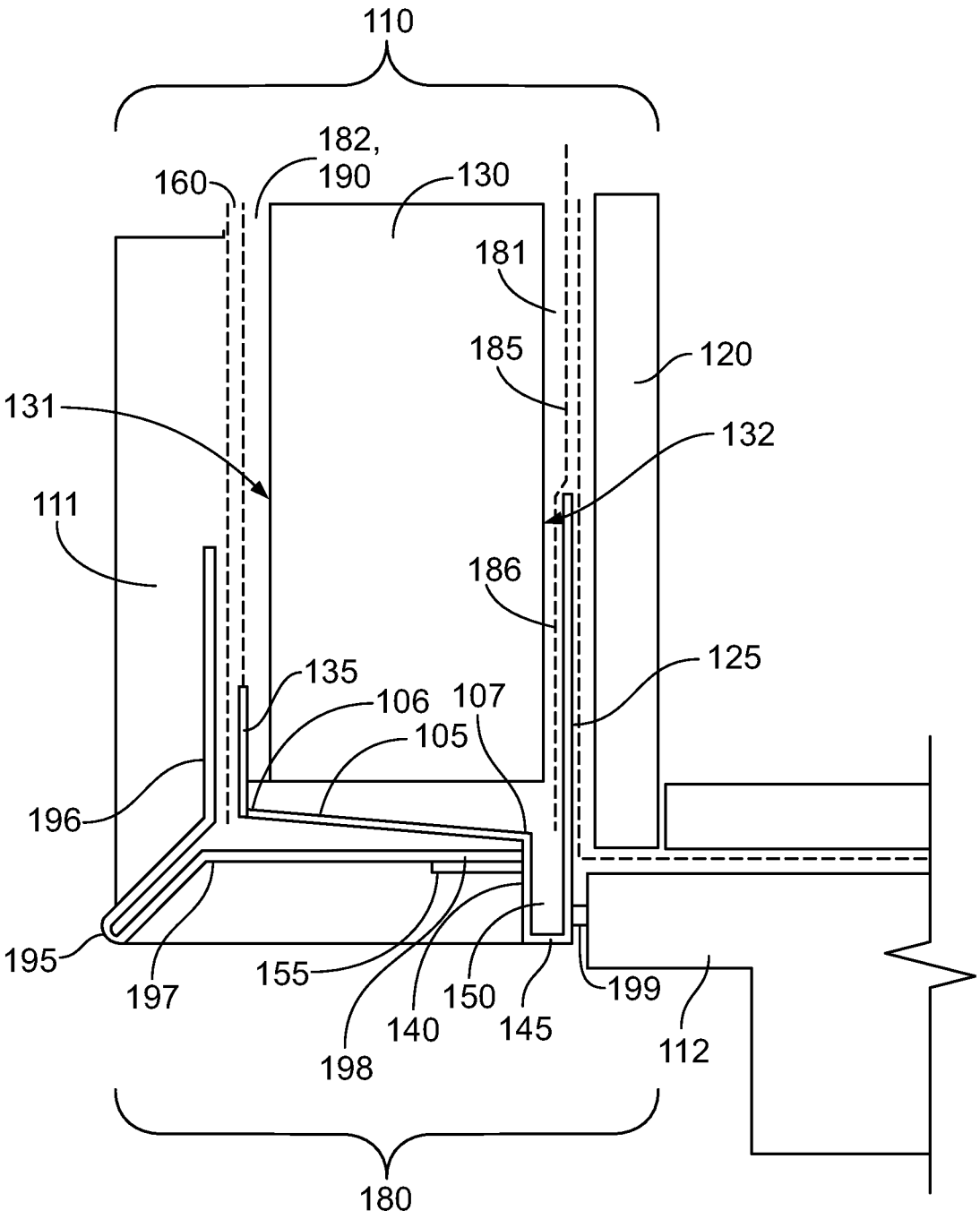
FIG. 5 is a side cross-sectional view of a drainage channel coupled disposed within a building wall, according to one example implementation.
Figure 6:
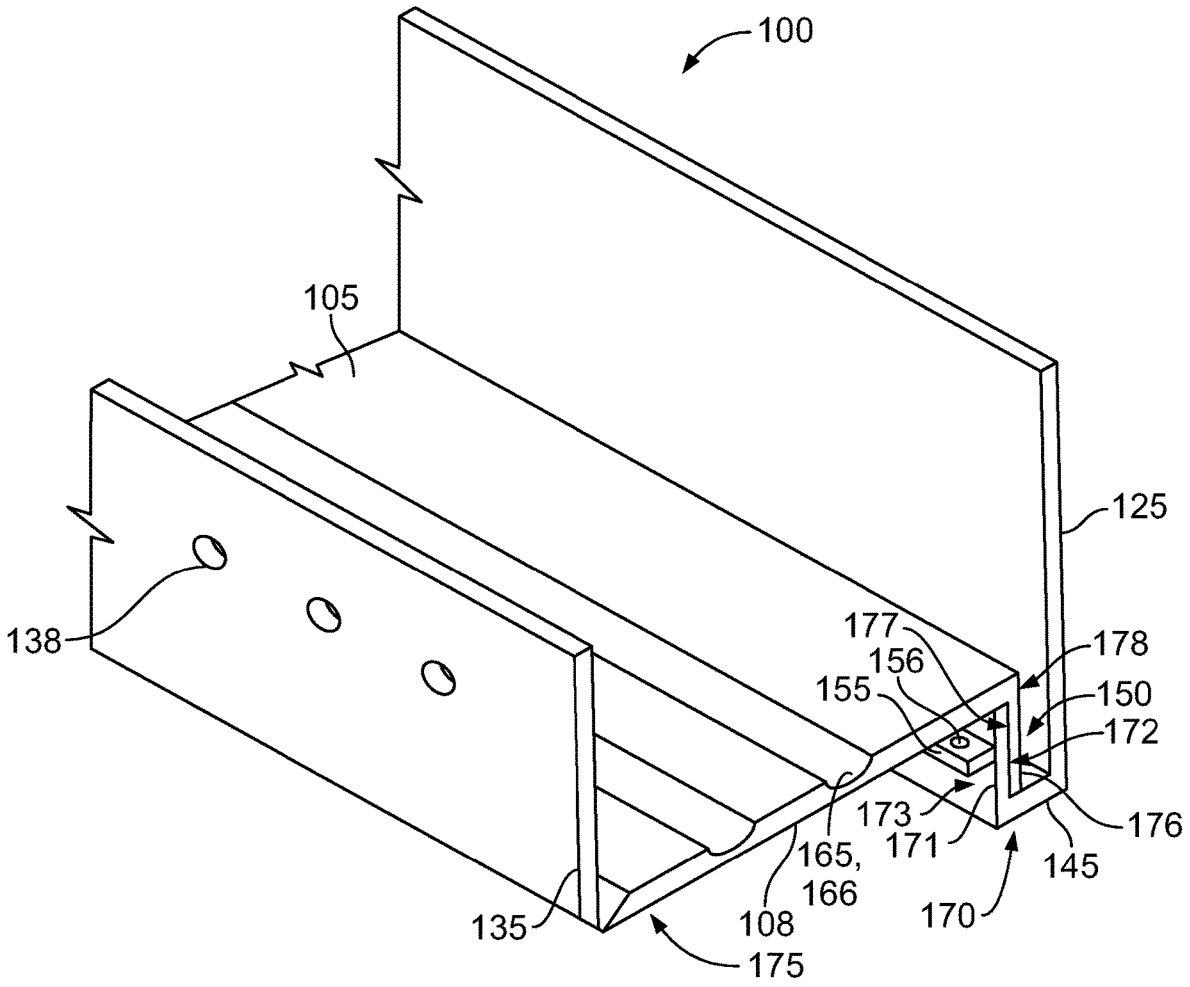
FIG. 6 is a perspective view of a drainage channel, according to one example implementation.

In one example implementation, the drainage panel 105 is configured to be positioned horizontally within the building wall 110 such that the first end 106 of the drainage panel 105 is positioned outboard of the second end 107 of the drainage panel 105. As shown in FIGS. 1 and 5-6, the support panel 115 is a front panel 135 coupled to the first end 106 of the drainage panel 105. The front panel 135 is configured to be fastened to a lath member 160 of the building wall 110, outboard of an insulating material 130 of the building wall 110. In this embodiment, the second end 107 of the drainage panel 105 may abut the weather resistant barrier 185, or may be positioned over the drainage well of an adjacent component, among other possibilities.

In some implementations, the drainage channel 100 may include both a front panel 135 and a rear panel 125, and thus may be coupled to adjacent wall components at both ends. Further, the drainage channel 100 may include additional components that may be used to integrate the drainage channel 100 within the overall drainage system 180 of the wall 110, described below.

In another example implementation shown in FIG. 5, the drainage panel 105 is angled downward from the first end 106 of the drainage panel 105 toward both the second end 107 of the drainage panel 105 and the exterior sheathing 120 of the building wall 110. This arrangement has the technical effect of draining water toward the exterior sheathing 120 using gravity.

Figure 3:
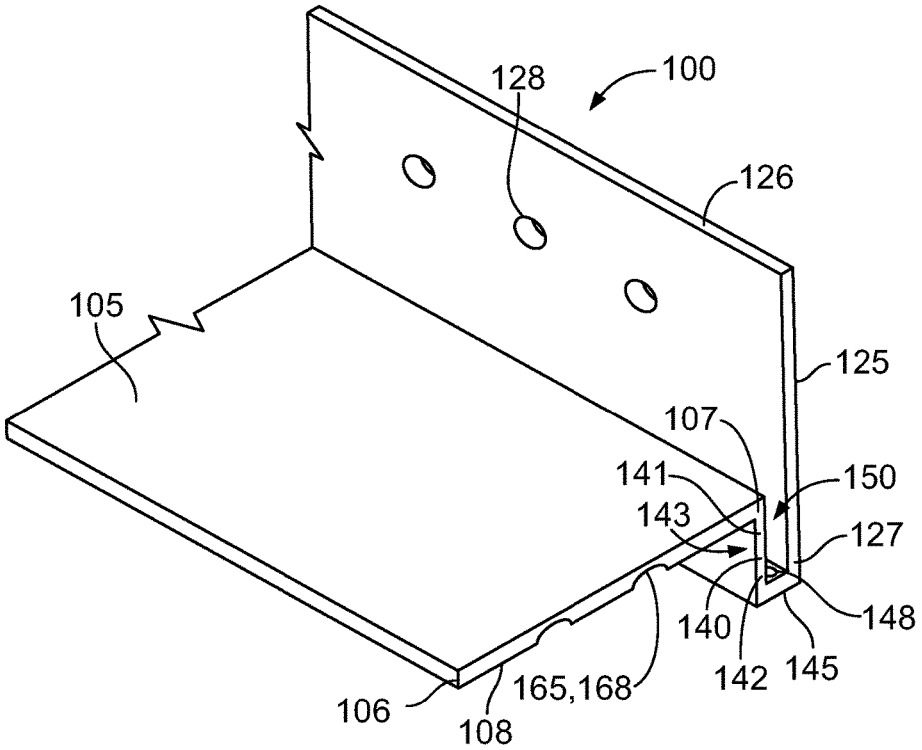
FIG. 3 is a perspective view of a drainage channel, according to one example implementation.
Figure 4:
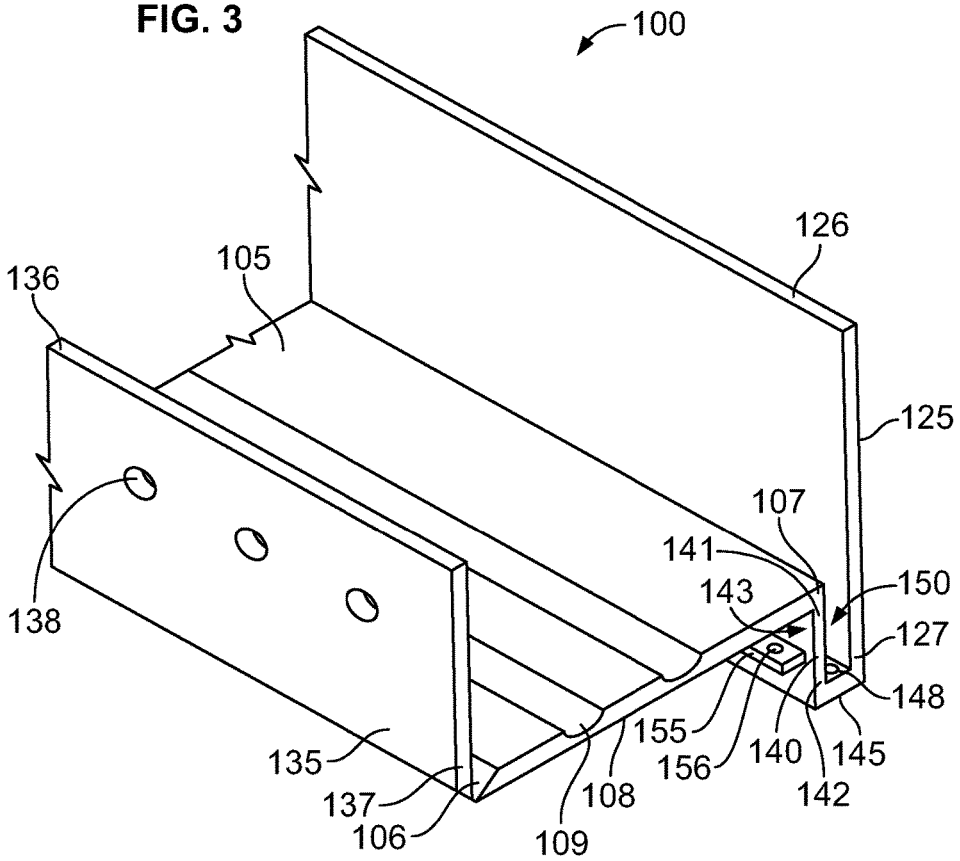
FIG. 4 is a perspective view of a drainage channel, according to one example implementation.

In still another example implementation shown in FIGS. 3-5, the support panel 115 is a rear panel 125, or alternatively, a front panel 135. In this example, the drainage channel 105 includes a rear panel 125 having a top end 126 and a bottom end 127. The drainage channel 105 also includes an intermediate panel 140 having a top end 141 and a bottom end 142. The intermediate panel 140 is parallel to the rear panel 125. The drainage channel 105 further includes a bottom panel 145 connecting the bottom end 127 of the rear panel 125 to the bottom end 142 of the intermediate panel 140 and forming a drainage well 150 between the rear panel 125 and the intermediate panel 140. The drainage channel 105 also includes a front panel 135 having a top end 136 and a bottom end 137. The front panel 135 is parallel to the rear panel 125. And the drainage panel 105 couples the bottom end 137 of the front panel 135 to the top end 141 of the intermediate panel 140.

In a further example implementation as shown in FIG. 3, the bottom panel 145 includes a plurality of apertures 148 configured to drain water therethrough. The technical effect of this arrangement is to permit water to drain away from the building wall 110 into the ground or a further drainage conduit.

In another example implementation shown in FIG. 3, the rear panel 125 includes a plurality of apertures 128 for receiving a fastener therethrough. In other examples, the rear panel 125 may be a substantially solid surface, and the fasteners may be driven through the rear panel 125. In some implementations, one or more fasteners may be driven into the exterior sheathing 120 such that it extends through the lath member 160, the water channel material 190, the insulating material 130, the weather resistant barrier 185, and in some cases, the rear panel 125 of the drainage channel 100. In yet another example implementation shown in FIGS. 1, 4 and 6, the front panel 135 includes a plurality of apertures 138 for coupling the front panel 135 of the drainage channel 105 with the lath member 160 of the building wall 110.

In still another example implementation, the drainage panel 105 includes a shelf 155 extending from and arranged perpendicular to either a front face 143 of the intermediate panel 140 or a front face 129 of the rear panel 125. In an optional implementation, the shelf 155 includes a plurality of apertures 156 therethrough for coupling the shelf 155 with a second flange 197 of a corner bead 195, discussed below.

In an optional implementation shown in FIGS. 1-4 and 6, the drainage channel 105 includes one or more lines 165 scored along a longitudinal length of the drainage panel 105. In this example, a respective portion of the drainage panel 105 is foldable about each of the scored lines 165 to position the respective portion of the drainage panel 105 parallel to the rear panel 125. For example, if the drainage panel 105 is too wide for the current application, a portion of the drainage panel 105 including the first end 106 may be folded upward to shorten the effective width of the drainage panel 105. The front panel 135 is foldable, in the opposite direction, about a connection of the front panel 135 and the drainage panel 105 to position the front panel 135 substantially parallel to the rear panel 125 and coplanar with the respective upwardly folded portion of the drainage panel 105. In various example implementations shown in FIGS. 1-2, 4 and 6, each of the one or more scored lines 165 includes a respective longitudinal notch 166 defined in a top surface 167 of the drainage panel 105. This arrangement may facilitate the upward fold of a portion of the drainage panel 105 discussed above. Further, as noted above, a small amount of water pooling within the longitudinal notches 166 may not have any significant adverse effects. Alternatively, as shown in FIG. 3, each of the one or more scored lines 165 includes a respective longitudinal notch 168 defined in a bottom surface 108 of the drainage panel 105. This may allow the top surface 167 of the drainage panel 105 to maintain a relatively smooth surface.

In an another optional implementation, the drainage panel 105 has a width extending from the first end 106 of the drainage panel 105 to the second end 107 of the drainage panel 105 of at least 1 inch. Depending on the requirements of a given application, the thickness of the insulating material 130 may vary from at least 1 inch, to at least 4 inches in some cases. Accordingly, the drainage panel 105 may include a width extending from the first end 106 to the second end 107 that is comparable to the thickness of the insulating material 130. Further, in some implementations, the drainage channel 100 as discussed herein may be adjustable to accommodate multiple different thicknesses of continuous insulating material 130.

In another example implementation, the rear panel 125 has a height extending from the top end 126 to the bottom end 127 of the rear panel 125. The intermediate panel 140 has a height extending from the top end 141 to the bottom end 142 of the intermediate panel 140. The front panel 135 has a height extending from the top end 136 to the bottom end 137 of the front panel 135. And the height of the rear panel 125 is greater than a combined height of the intermediate panel 140 and the front panel 135, as shown in FIGS. 4-6. Other possibilities and orientations of the panels may exist.

In any of the examples discussed above, the drainage channel 100 may be integrally formed as a single component. Alternatively, in an another example implementation shown in FIG. 6, the drainage channel 100 is formed from at least a first drainage channel component 170 that includes the rear panel 125 and the bottom panel 145, and a second drainage channel component 175 that includes the front panel 135 and the drainage panel 105. The intermediate panel 140 includes a first intermediate panel 171 of the first drainage channel component 170 positioned adjacent to a second intermediate panel 176 of the second drainage channel component 175. In a further optional implementation, the rear face 172 of the first intermediate panel 171 is positioned adjacent to a front face 177 of the second intermediate panel 176 such that the first drainage channel component 170 forms a front face 173 of the intermediate panel 140. And the second intermediate panel 175 forms a rear face 178 of the intermediate panel 140.

In a further optional implementation, the first and second intermediate panels 170, 175 may be fastened together. Alternatively, the first drainage channel component may be fastened to the exterior sheathing 120, and then the second drainage channel component 175 may partially rest atop the first drainage channel component 170 without fastening the two together.

Referring to FIG. 5, a drainage system 180 is shown for attachment to an exterior sheathing 120 of a panel structure 185. The drainage system 180 includes a weather resistive barrier 185 coupled to the exterior sheathing 120. The weather resistive barrier 185 forms a secondary drainage plane 181 of the drainage system 180. The drainage system 180 also includes insulating material 130 is coupled to the exterior sheathing 120. The insulating material 130 is positioned outboard of and adjacent to the weather resistive barrier 185. The drainage system 180 further includes a water channel material 190 coupled to the exterior sheathing 120. The water channel material 190 is positioned outboard of and adjacent to the insulating material 130. The water channel material 190 forms a primary drainage plane 182 of the drainage system 180. The drainage system 180 still further includes a lath member 160 coupled to the exterior sheathing 120. The lath member 160 is positioned outboard of and adjacent to the water channel material 190. And the drainage system 180 includes, the drainage channel 100 according to any of the foregoing implementations. The first end 106 of the drainage panel 105 is positioned outboard of the water channel material 190 such that any water from the primary drainage plane 182 is directed inboard toward the weather resistive barrier 185.

In some example implementations, the bottommost portion 186 of the weather resistant barrier 185 may terminate in front of the rear panel 125, such that any water draining down the weather resistant barrier 185 is directed into the drainage well 150. Alternatively, the rear panel 125 may be fastened to the exterior sheathing 120 behind the continuous insulating material 130, but outboard of the weather resistant barrier 185.

Further, the first end 106 of the drainage panel 105 may be positioned outboard of, and below, the primary drainage plane 182 on the front side 131 of the continuous insulating material 130. The second end 107 of the drainage panel 105 may be positioned inboard of the continuous insulation and adjacent to the weather resistive barrier 185 such that water on the drainage panel 105 can make a fluid connection with water in the secondary drainage plane 181 on the weather resistive barrier 185. For instance, the second end 107 the drainage panel 105 may abut the weather resistive barrier 185, and may be formed with optional grooves or notches 109, as shown in FIG. 1, that allow water on the drainage panel 105 to drain from the drainage panel 105 and down the weather resistive barrier 185. Other arrangements are also possible. In this way, water that drains down from the primary drainage plane 182 may be collected by the drainage panel 105, and then conveyed toward the weather resistive barrier 185.

In one example implementation of the drainage system 180, a rear panel 125 is coupled to the exterior sheathing 120 and inboard of a portion of the weather resistive barrier 185 such that any water in the secondary drainage plane 181 is directed to a drainage well 150 of the drainage channel 100. And a front panel 135 is positioned outboard of the water channel material 190 such that any water in the primary drainage plane 182 is directed to the drainage well 150 via the drainage panel 105.

In another example implementation of the drainage system 180, the drainage system 180 is coupled to the exterior sheathing 120 via a plurality of fasteners. Each fastener in the plurality of fasteners extending through the lath member 160, the water channel material 190, the insulating material 130, and the weather resistive barrier 185. In one optional implementation, the lath member 160 is positioned outboard of the front panel 135. And the lath member 160 is coupled to the front panel 135 by one or more fasteners via a plurality of apertures 138 in the front panel 135. In another optional implementation, the insulating material 130 includes a front side 131 and a back side 132 defining a thickness therebetween. And the thickness of the insulating material 130 is a least 1 inch.

Referring to FIG. 5, a building wall 110 includes an exterior sheathing 120. The building wall 110 also includes the drainage system 180 coupled to the exterior sheathing 120 via a plurality of fasteners. The building wall 110 further includes a corner bead 195 that has a first flange 196 and a second flange 197. The first flange 196 is coupled to the lath member 160 that is arranged vertically, and the second flange 197 is positioned adjacent to a bottom surface 108 of the drainage panel 105 and perpendicular to the first flange 196. And the building wall 110 includes a cementitious material 111 applied to the lath member 160 and the corner bead 195. The corner bead 195 may facilitate the structural support of the stucco surface. For example, the first flange 196 and the second flange 197 of the corner bead 195 may be provided at the corner where the exterior face of the wall 110 meets the return at the bottom of the wall 110. In addition, the first and second flanges 196, 197 may be perforated.

In one example implementation, an end 198 of the second flange 197 of the corner bead 195 is positioned atop a shelf 155 of the drainage channel 110. In a further optional implementation, the end 198 of the second flange 197 is fastened to the shelf 155 via the plurality of apertures in the shelf 155. This arrangement may allow the end 198 of the second flange 197 to be supported in part by the drainage channel 100, which is affixed to the exterior sheathing 120. In an alternative arrangement, the end 198 of the second flange 197 terminates as a sort of cantilever, and the stucco return 111 is supported by the stiffness of the first flange 196.

In various implementations, a sealant 199 may be applied between the rear panel 125 and the foundation 112 of the building wall 110.

Figure 7:
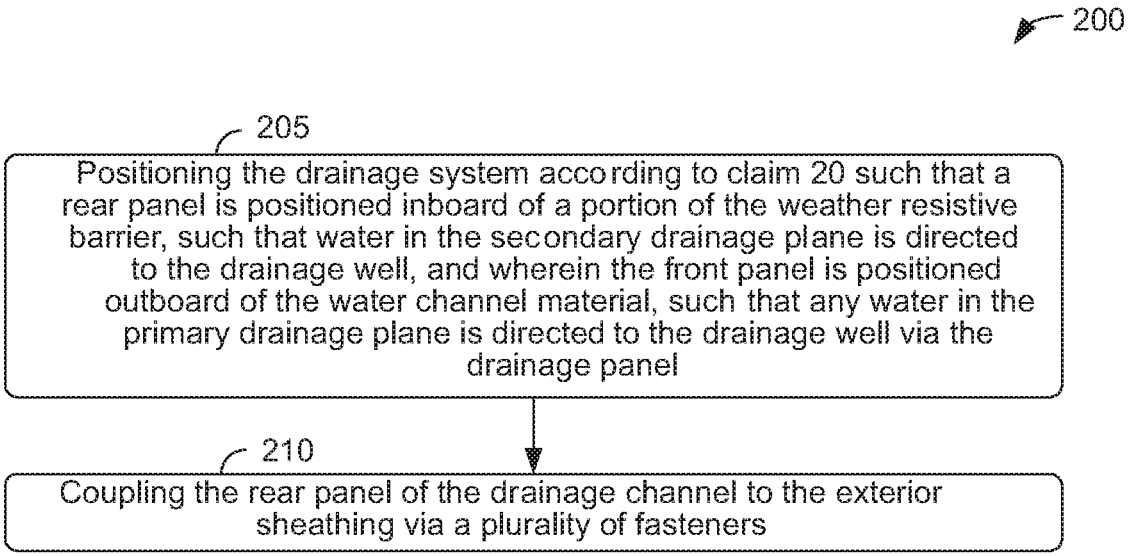
FIG. 7 shows a flowchart of a method, according to an example implementation.

Referring now to FIG. 7, a method 200 for installing a drainage channel 100 within a building wall 110. Method 200 includes, at block 205, positioning the drainage system 180 such that a rear panel 125 is positioned inboard of a portion of the weather resistive barrier 185 such that water in the secondary drainage plane 181 is directed to the drainage well 150. And the front panel 135 is positioned outboard of the water channel material 190 such that any water in the primary drainage plane 182 is directed to the drainage well 150 via the drainage panel 105. Then, at block 210, the rear panel 125 of the drainage channel 100 is coupled to the exterior sheathing 120 via a plurality of fasteners.

In one example implementation, method 200 further includes coupling the lath member 160 to a front panel 135 of the drainage channel 100. In a further implementation, coupling the lath member 160 to the front panel 135 of the drainage channel 100 includes wiring the lath member 160, via a plurality of openings in the lath member 160, to the front panel 135 of the drainage channel 100 via the plurality of apertures 138 in the front panel 135.

In a further example implementation, method 200 further includes folding a respective portion of the drainage panel 105 about one of the scored lines 165 of the drainage panel 105 to position the respective portion of the drainage panel 105 parallel to the rear panel 125. And then the front panel 135 is folded about the connection of the front panel 135 and the drainage panel 105 to position the front panel 135 coplanar with the respective portion of the drainage panel 105.

In still another example implementation, method 200 includes fastening a first flange 196 of a corner bead 195 to the lath member 160. Next, a second flange 197 of the corner bead 195 is positioned adjacent to a bottom surface 108 of the drainage panel 105 and perpendicular to the first flange 196. In a further optional implementation, an end 198 of the second flange 197 of the corner bead 195 is positioned atop the shelf 155 of the drainage channel 100. And the second flange 197 of the corner bead 195 may be coupled to the shelf 155 via the plurality of apertures 156 in the shelf 155.

For example, in one implementation, coupling the second flange 197 of the corner bead 195 to the shelf 155 includes wiring the second flange 197 of the corner bead 195, via a plurality of openings in the second flange 197 of the corner bead 195, to the shelf 155 via the plurality of apertures 156 in the shelf 155.

In another optional implementation, method 200 includes applying a cementitious material 111 to the lath member 160 and the corner bead 195.

The description of different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

The invention claimed is:

1. A drainage channel comprising:

a drainage panel for conveying water from within a building wall, wherein the drainage panel is impermeable and comprises a first end and a second end; and a rear panel coupled to the second end of the drainage panel such that the rear panel is configured to be coupled to an exterior sheathing of the building wall and arranged vertically relative to the building wall, the rear panel having a top end and a bottom end;

an intermediate panel having a top end and a bottom end, wherein the intermediate panel is parallel to the rear panel;

a bottom panel connecting the bottom end of the rear panel to the bottom end of the intermediate panel and forming a drainage well between the rear panel and the intermediate panel;

a front panel having a top end and a bottom end, wherein the front panel is parallel to the rear panel; and wherein the first end of the drainage panel is coupled to the bottom end of the front panel and the second end of the drainage panel is coupled to the top end of the intermediate panel, wherein the drainage panel is angled downward from the front panel to the intermediate panel to convey water from a primary drainage plane at the front panel to a secondary drainage plane at the rear panel.

2. The drainage channel of claim 1, wherein the drainage panel is configured to be positioned within the building wall such that the first end of the drainage panel is positioned outboard of the second end of the drainage panel relative to an exterior sheathing of the building wall, and wherein the rear panel is configured to be fastened to the exterior sheathing of the building wall and inboard of an insulating material of the building wall.

3. The drainage channel of claim 1, wherein the front panel is configured to be fastened to a lath member of the building wall, outboard of an insulating material of the building wall.

4. The drainage channel of claim 1, wherein the bottom panel comprises a plurality of apertures configured to drain water therethrough.

5. The drainage channel of claim 1, wherein the rear panel comprises a plurality of apertures for receiving a fastener therethrough.

6. The drainage channel of claim 1, wherein the front panel comprises a plurality of apertures for coupling the front panel of the drainage channel with a lath member of the building wall.

7. The drainage channel of claim 1, further comprising:

a shelf extending from and arranged perpendicular to either a front face of the intermediate panel or a front face of the rear panel.

8. The drainage channel of claim 7, wherein the shelf comprises a plurality of apertures therethrough for coupling the shelf with a second flange of a corner bead.

9. The drainage channel of claim 1, further comprising: one or more lines scored along a longitudinal length of the drainage panel, wherein a respective portion of the drainage panel is foldable about each of the scored lines to position the respective portion of the drainage panel parallel to the rear panel, and wherein the front panel is foldable about a connection of the front panel and the drainage panel to position the front panel substantially coplanar with the respective portion of the drainage panel.

10. The drainage channel of claim 9, wherein each of the one or more scored lines comprises a respective longitudinal notch defined in a top surface of the drainage panel.

11. The drainage channel of claim 9, wherein each of the one or more scored lines comprises a respective longitudinal notch defined in a bottom surface of the drainage panel.

12. The drainage channel of claim 1, wherein the drainage panel has a width extending from the first end of the drainage panel to the second end of the drainage panel of at least 1 inch.

13. The drainage channel of claim 1, wherein the rear panel has a height extending from the top end to the bottom end of the rear panel, wherein the intermediate panel has a height extending from the top end to the bottom end of the intermediate panel, wherein the front panel has a height extending from the top end to the bottom end of the front panel, and wherein the height of the rear panel is greater than a combined height of the intermediate panel and the front panel.

14. The drainage channel of claim 1, wherein the drainage panel, the rear panel, the front panel, the bottom panel and the intermediate panel are formed from at least one of a polymer-based material, a metal material, a metal alloy material, or a composite material.

15. The drainage channel of claim 1, wherein the drainage channel is integrally formed as a single component.

16. The drainage channel of claim 1, wherein the drainage channel is formed from at least a first drainage channel component comprising the rear panel and the bottom panel, and a second drainage channel component comprising the front panel and the drainage panel, and wherein the intermediate panel includes a first intermediate panel of the first drainage channel component positioned adjacent to a second intermediate panel of the second drainage channel component.

17. The drainage channel of claim 16, wherein a rear face of the first intermediate panel is positioned adjacent to a front face of the second intermediate panel, such that the first drainage channel component forms a front face of the intermediate panel, and wherein the second intermediate panel forms a rear face of the intermediate panel.

18. A drainage system for attachment to an exterior sheathing of a panel structure, the drainage system comprising:

a weather resistive barrier coupled to the exterior sheathing, wherein the weather resistive barrier forms the secondary drainage plane of the drainage system;

an insulating material coupled to the exterior sheathing, wherein the insulating material is positioned outboard of and adjacent to the weather resistive barrier;

a water channel material coupled to the exterior sheathing, wherein the water channel material is positioned outboard of and adjacent to the insulating material, and wherein the water channel material forms a primary drainage plane of the drainage system;

a lath member coupled to the exterior sheathing, wherein the lath member is positioned outboard of and adjacent to the water channel material; and the drainage channel according to claim 1, wherein the first end of the drainage panel is positioned outboard of the water channel material such that any water from the primary drainage plane is directed inboard toward the weather resistive barrier.

* * * * *